United States Patent [19]

Chiappetta et al.

[11] Patent Number: 4,487,010

[45] Date of Patent: Dec. 11, 1984

[54] MULTI-LAYER, PARALLEL LAY, CORELESS WIRE ROPE

[75] Inventors: Ferdinand Chiappetta; John H. Simpson; Neville H. Simpson, all of Kenosha, Wis.

[73] Assignee: AMSTED Industries Incorporated, Chicago, Ill.

[21] Appl. No.: 467,970

[22] Filed: Feb. 18, 1983

[51] Int. Cl.[3] ..... D07B 1/06; D07B 1/16; D07B 7/12

[52] U.S. Cl. ..... 57/213; 57/217; 57/218; 57/221

[58] Field of Search ..... 57/200, 210, 212–215, 57/217–223, 232

[56] References Cited

U.S. PATENT DOCUMENTS

| | | | |
|---|---|---|---|
| 1,481,934 | 1/1924 | Sunderland | 57/215 |
| 2,098,163 | 11/1937 | Reed | 57/213 X |
| 3,555,789 | 1/1971 | Terragna | 57/218 |
| 3,729,921 | 5/1973 | Stroh | 57/215 X |
| 3,824,777 | 7/1974 | Riggs | 57/217 X |
| 4,158,946 | 6/1979 | Bourgois | 57/230 X |
| 4,311,001 | 1/1982 | Glushko et al. | 57/215 |

*Primary Examiner*—Donald Watkins

*Attorney, Agent, or Firm*—Fred P. Kostka; Charles E. Bouton

[57] ABSTRACT

The present invention provides a wire rope comprising an inner layer of at least four separate wire strands and an outer layer of at least eight separate wire strands, parallel laid. The strands themselves are usually of parallel lay and are usually lubricated. A thermoplastic or an elastomer usually surrounds the inner layer strands and extends between the inner layer strands and the outer layer strands and between the outer layer strands.

7 Claims, 8 Drawing Figures

MULTI-LAYER, PARALLEL LAY, CORELESS WIRE ROPE

BACKGROUND OF THE INVENTION

The present invention relates to a multi-layer, parallel lay, coreless wire rope.

Multi-layer, parallel lay, coreless wire rope configurations exhibit greater resistance to crushing, are more stable and have longer rope life than multi-layer, parallel lay wire ropes having a core strand. However, there are certain undesirable features of coreless wire ropes of designs similar to those set forth in U.S. Pat. No. 3,181,291.

Such prior art ropes have inherent disadvantages. The three strand interior rope introduces a stiffness factor that differs greatly from the stiffness factor of the outer rope six strands. This difference can, under certain operating conditions, cause the interior rope to expand in an area or "pop" and the exterior rope to expand overall or "birdcage." This difference in stiffness factors resists any attempts at modifying the interior rope three strand design or configuration to produce a more flexible interior rope. The six exterior strands are minimal in number and do not provide sufficient outside wire surface area for optimum abrasion resistance and wire contact stress distribution.

Further, due to the component strand diameter differences, the ropes lack uniformity between strands and have less resistance to abrasion, bending fatigue, crushing and bearing stresses.

Accordingly, it is an object of the present invention to provide a multi-layer, coreless, parallel-lay wire rope that has improved stability, strength and rope life.

SUMMARY OF THE INVENTION

The present invention provides a multi-layer, coreless, parallel lay wire rope with improved resistance to abrasion, bending fatigue, crushing and bearing stresses. More specifically, the wire rope of the present invention has an interior rope comprising four separate strands arranged in a coreless configuration and an outer rope comprising at least eight separate strands.

The wire rope of the present invention usually will comprise lubricated strands encapsulated in a thermoplastic or an elastomer. Patents relating to such thermoplastic impregnation of wire ropes include U.S. Pat. Nos. 3,824,777 and 3,874,158. The individual wire strands are lubricated in an extrusion process with a conventional lubricant such as petrolatum at about room temperature, or with an asphaltic based lubricant which is applied at about 150° F. (65° C.). The lubricated strand rope is then thermoplastic encapsulated in an extrusion operation. The rope is passed through an extrusion die wherein the thermoplastic is injected into the rope, extending to the inner rope and between inner rope strands and outer rope strands and between outer rope strands. Such thermoplastic encapsulation inhibits the entrance of foreign abrasive particles into the rope, seals the lubricant within the rope for optimnal lubrication life, minimizes rope metal to outside metal contact for increased rope strength and life, and locks the component strands in their respective fabricated positions to provide increased resistance to strand expansion such as popping or bird caging.

The wire rope of the present invention could be of a swaged construction whereby the entire rope can be either roller or die compacted.

DESCRIPTION OF THE PREFERRED EMBODIMENTS

Figure 1:
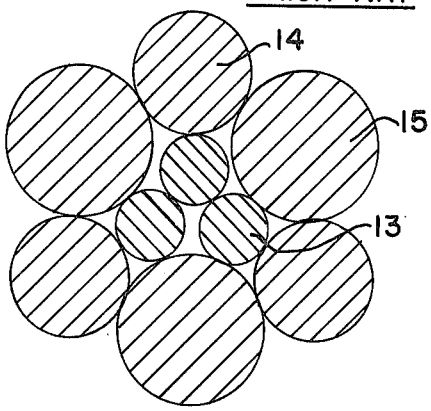
FIG. 1 PRIOR ART
FIG. 1 is a cross section view of a prior art wire rope.
Figure 2:
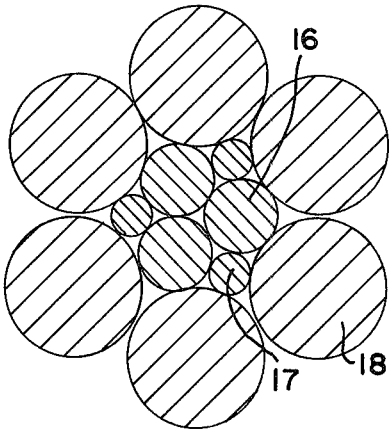
FIG. 2 PRIOR ART
FIG. 2 is a cross section view of another prior art wire rope.

FIGS. 1 and 2 show prior art wire rope constructions. In FIG. 1, the inner rope comprises three separate strands 13 arranged in a coreless configuration. The outer rope comprises six separate strands, three strands 14 each of a small diameter and three strands 15 each of a larger diameter, arranged in an alternating configuration around the inner rope, usually referred to as a Warrington configuration. In FIG. 2, the inner rope comprises three strands 16 of equal diameter. The outer rope comprises six strands 18 of equal but larger diameter. A supporting spacer layer of three strands 17 of equal but smallest diameter is utilized in a Filler Wire Configuration. Such rope design configurations have the disadvantages set forth above.

For the wire rope shown in FIG. 1, the diameter of strand 15 is about 1.2 times the diameter of strand 14 and about 1.9 times the diameter of strand 13. For the wire rope shown in FIG. 2, the diameter of strand 18 is 2.2 times the diameter of strand 16 and about 5.5 times the diameter of strand 17.

Figure 3:
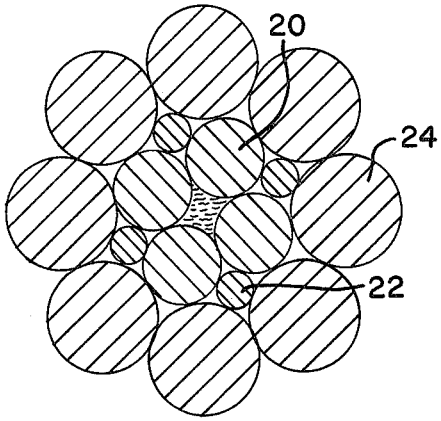
FIG. 3 is a cross section view of a first wire rope made in accordance with the present invention.

A first embodiment of a wire rope made in accordance with the present invention is shown in FIG. 3. A two-layer, parallel lay, coreless wire rope of Filler Wire configuration is shown. The inner rope layer comprises four larger diameter strands 20 and four smaller diameter filler wire strands 22. The outer rope layer comprises eight large diameter strands 24 which are wound about the inner rope. Each of the inner rope strands and the outer rope strands is comprised of a plurality of individual wires. The diameter of outer rope strands 24 is about 125% of the diameter of inner rope strands 20.

Figure 4:
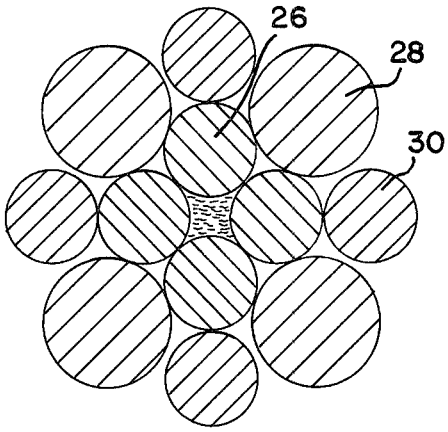
FIG. 4 is a cross section view of a second wire rope made in accordance with the present invention.
Figure 5:
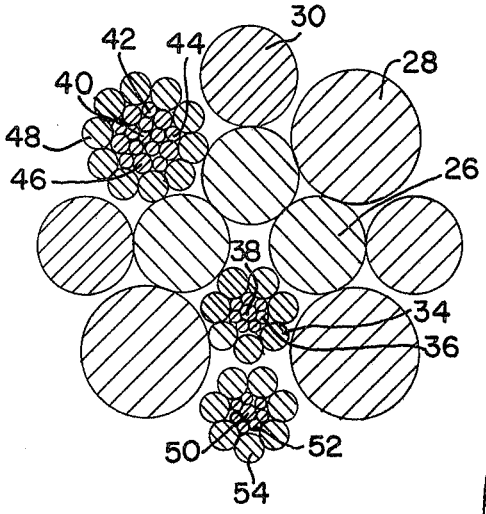
FIG. 5 is a detailed cross section view of the wire rope shown in FIG. 4.

A second embodiment of the present invention is shown in FIGS. 4 and 5. The inner rope layer comprises four strands 26 of equal diameter arranged in a coreless configuration. The outer rope layer comprises four large diameter strands 28 and four smaller diameter strands 30 arranged alternately which are wound around the interstices of the inner rope. The wire rope comprises a two-layer, parallel lay, coreless wire rope of Warrington configuration. As shown in detail in FIG. 5, each of the inner rope strands and the outer rope strands is comprised of a plurality of individual wires. The diameter of inner rope strands 26 is about 75% of the diameter of outer strands 28, with outer rope strands 30 having a diameter equal to that of strands 26.

Referring now to FIG. 5, the interior layer rope comprises four strands 26 laid in a right regular lay construction. Each strand 26 comprises a center wire 38, surrounded by seven inner wires 36 of smaller diameter than center wire 38. Seven outer wires 34 of larger diameter surround inner wires 36. This arrangement is referred to as a fifteen wire Seale configuration. All component wires 34, 36 and 38 of strand 26 are laid in a left hand counter clockwise direction, whereas the strands 26 themselves are laid in a right hand clockwise direction.

The outer layer of the rope shown in FIG. 5 has four strands 30 of a diameter identical to that of strands 26 and four larger diameter strands 28 laid alternately in a right lang lay direction. Each large diameter strand 28 comprises a center wire 40 which is surrounded by five larger diameter inner wires 42. Ten intermediate wires surround inner wires 42, said intermediate wires comprising five smaller diameter wires 44 and five larger diameter wires 46 laid alternately. Ten outer wires 48 surround the intermediate wires 44 and 46. Inner wires 42, intermediate wires 44 and 46 and outer wires 48 are laid in a right hand clockwise direction.

Each smaller diameter strand 30 comprises a center wire 50 surrounded by seven inner wires 52, with seven outer wires 54 surrounding inner wires 52. Inner wires 52 and outer wires 54 are laid in a right hand clockwise direction. Further, outer strands 28 and 30 are themselves laid in a right hand clockwise direction. Outer large strands 28 are shown in a twenty-six wire, parallel lay, Warrington-Seale configuration, and outer smaller strands 30 are shown in a fifteen wire, parallel lay, Seale configuration.

The outer strands 28 and 30 and the inner strands 26 are laid up in parallel lay, wherein all strands are fabricated to identical length and direction of lay, preferably simultaneously in the same fabricating machine. Further, the outer wires 48 of outer strands 28, outer wires 54 of outer strands 30 and outer wires 34 of inner strands 26 are all of equal diameter.

Figure 6:
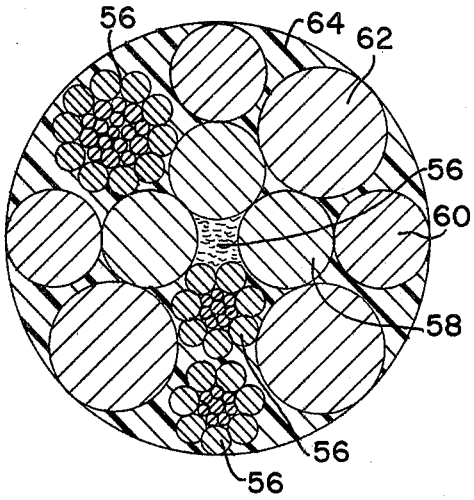
FIG. 6 is a detailed cross section view of a thermoplastic encapsulated wire rope made in accordance with the present invetion.

Referring now to FIG. 6, a wire rope of structure identical to FIG. 5 is shown, with the addition of a lubricant 56 shown in the core area of the rope, and also present within inner strands 58, equal diameter outer strands 60 and larger diameter outer strands 60. Further, a thermoplastic 64 extends from the inner strands 58 to the outer diameter of outer strands 60, 62. Thermoplastic 64 is present in the interstices between inner strands 58 and outer strands 60, 62 and between the outer strands 60,62. Each of the inner rope strands 58 and the outer rope strands 60, 62 is comprised of a plurality of individual wires, as shown in FIG. 6. However, these wires are of an identical configuration as described in FIG. 5, so such detailed description of FIG. 6 is not provided here.

Figure 7:
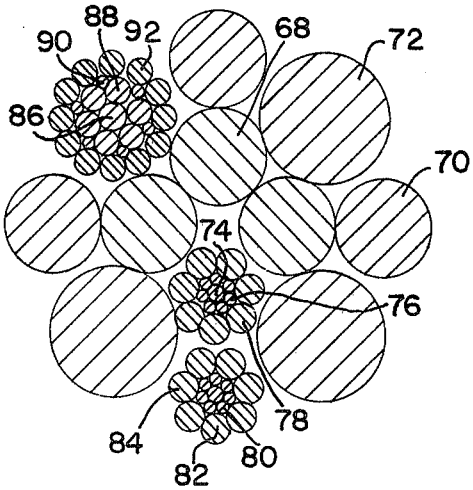
FIG. 7 is a detailed cross section view of a wire rope made in accordance with the present invention.

Referring now to FIG. 7, a two-layer, parallel lay, coreless wire rope is shown. The interior rope comprises four strands 68 laid in a right regular lay construction, and the exterior rope comprises eight strands, four strands 70 of a diameter identical to that of inner strands 68 and four larger diameter strands 72 with a diameter about 125% that of strands 68, laid alternately around inner strands 68. Each strand 68 comprises a center wire 74 surrounded by nine inner wires 76 of smaller diameter than center wire 74. Nine outer wires 78 surround inner wires 76. This arrangement is referred to as a nineteen wire Seale configuration. Component wires 76 and 78 are laid in a left hand counter clockwise direction, whereas strands 68 themselves are laid in a right hand clockwise direction.

The outer layer rope shown in FIG. 7 has four strands 70 of a diameter identical to that of inner strands 68 laid alternately with four strands 72 of a larger diameter laid alternately in a right lang lay direction. Each smaller diameter strand 70 comprises a center wire 80 surrounded by nine inner wires 82, with nine outer wires 84 surrounding inner wires 82. Inner wires 82 and outer wires 84 are laid in a right hand clockwise direction. Larger diameter strands 72 are of a twenty-five wire, parallel lay, Filler wire configuration. A center wire 86 is provided, surrounded by six inner wires 88 of identical diameter. Six filler wires 90 of smaller diameter than inner wires 88 are provided in the interstices between inner wires 88 and the twelve outer wires 92 that surround them.

Figure 8:
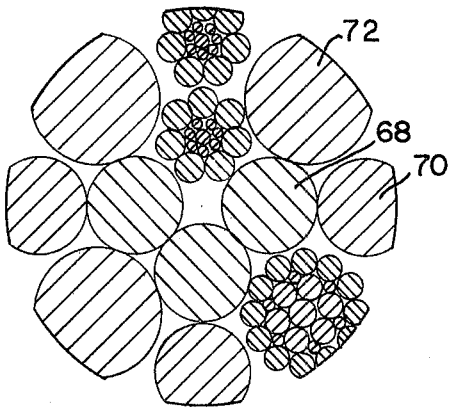
FIG. 8 is a detailed cross section view of a compacted wire rope made in accordance with the present invention.

A wire rope identical to that shown in FIG. 7 is shown in FIG. 8, except that outer strands 70 and 72 have been compacted by either roller or die compaction. This can be a preferred configuration of the wire rope of the present invention, because when the diameter of a compacted rope is compared with the same diameter of non-compacted rope, the compacted rope has a significantly greater strength and wear properties.

It should be mentioned that the embodiments of the present invention shown in FIGS. 7 and 8 could be lubricated and encapsulated in a thermoplastic in a manner similar to the rope shown in FIG. 6. Other strand configurations can be utilized in assembling the inner rope and the outer rope layers than these described herein, and still fall within the scope of the present invention, namely, a multi-layer, coreless, parallel lay wire rope.

What is claimed is:

1. A multilayer parallel wire rope comprising:

(a) an inner rope having at least four separate strands arranged in a coreless configuration (b) an outer rope having at least eight separate strands of large diameter strand and alternate strands of smaller diameter strands of substantially equal diameter as said strands of said inner rope laid on said inner coreless rope; and (c) filler wire strands located between said inner rope and said outer rope.

2. The wire rope of claim 1, wherein the diameter of the inner rope strands is 75 to 125% of the diameter of the outer rope strands.

3. The wire rope of claim 1, wherein the outer rope strands are compacted or swaged to form a wire rope of lesser over all diameter.

4. The wire rope of claim 1, wherein the inner rope strands and the outer rope strands are lubricated, and a thermoplastic or elastomer surrounds the inner rope strands and extends into the interstices between the inner rope strands and the outer rope strands and between the outer rope strands.

5. A method of making wire rope including the steps of providing at least four inner rope strands, lubricating each inner rope strand, winding at least eight lubricated outer rope strands around said lubricated inner rope strands to form a wire rope, surrounding the wire rope with a thermoplastic or elastomer which extends into the interstices between the outer rope strands and the inner rope strands.

6. A wire rope comprising an inner layer of at least four parallel lay lubricated wire strands arranged in a coreless configuration, an outer layer of at least eight parallel lay lubricated wire strands surrounding said inner layer strands to form a wire rope, a thermoplastic surrounding the inner layer and extending between said inner layer strands and said outer layer strands and between said outer layer strands, to maintain said lubricant within said inner layer strands and said outer layer strands.

7. The wire rope of claim 6 wherein said wire rope is compacted or swaged to reduce the diameter of the wire rope.

* * * * *